United States Patent [19]

Schaefer

[11] Patent Number: 4,988,091

[45] Date of Patent: Jan. 29, 1991

[54] ELBOW AND FOREARM REHABILITATION DEVICE

[76] Inventor: Michael J. Schaefer, 2672 Honeysuckle Dr., Richardson, Tex. 75082

[21] Appl. No.: 558,749

[22] Filed: Jul. 27, 1990

[51] Int. Cl.[5] ..... A63B 23/12; A63B 21/065

[52] U.S. Cl. ..... 272/67; 272/68; 272/117; 272/119; 128/26

[58] Field of Search ..... 272/67, 68, 117, 119; 128/77, 25 R, 26

[56] References Cited

U.S. PATENT DOCUMENTS

| | | | |
|---|---|---|---|
| 1,295,297 | 2/1919 | French . | |
| 1,658,108 | 2/1928 | Vaughn | 272/67 |
| 3,606,316 | 9/1971 | Krewer | 272/67 |
| 3,814,419 | 6/1974 | Bjorklund et al. | 272/80 |
| 3,924,851 | 12/1975 | Winston | 272/67 |
| 4,039,183 | 8/1977 | Sakwada | 272/67 |
| 4,191,373 | 3/1980 | Lancellotti | 273/29 A |
| 4,220,327 | 9/1980 | Herbowy | 272/67 |
| 4,226,412 | 10/1980 | Panepinto | 272/68 |
| 4,419,991 | 12/1983 | Lee | 128/88 |
| 4,671,258 | 6/1987 | Barthlome | 128/26 |
| 4,763,901 | 8/1988 | Richter | 273/29 R |
| 4,768,783 | 9/1988 | Engalitcheff, Jr. | 272/143 |
| 4,832,031 | 5/1989 | Last . | |

FOREIGN PATENT DOCUMENTS

| | | | |
|---|---|---|---|
| 295632 | 10/1914 | Fed. Rep. of Germany | 272/139 |

*Primary Examiner*—Richard J. Apley
*Assistant Examiner*—Karen G. Horowitz
*Attorney, Agent, or Firm*—Ross, Howison, Clapp & Korn

[57] ABSTRACT

An elbow and forearm rehabilitation device to be grasped by a hand of a user includes a frame having first and second side members. Each side member includes first and second ends. A hand grip is interconnected to the first ends of the side members for receiving the hand of the user between the first and second side members. The first and second side members include a bend disposed between the first and second ends, such that the first and second side members disposed between the bend and the second ends lie in a plane substantially parallel to the plane of the user's arm when the back of the hand is rotated, upon full rotation of the wrist, toward the user's elbow.

20 Claims, 6 Drawing Sheets

ELBOW AND FOREARM REHABILITATION DEVICE

TECHNICAL FIELD OF THE INVENTION

This invention relates to rehabilitation devices, and more particularly to a device for treating elbow tendinitis, especially lateral and medial epicondylitis.

BACKGROUND OF THE INVENTION

Epicondylitis, known more commonly as "tennis elbow", is a painful inflammation of the inside or outside of the elbow joint. The condition is commonly associated with racquet sports, golf, fishing, and bowling; however, many occurrences are work related, brought on by repeated hammering, painting, or digging. Very often it is the weekend athlete or handyman that experiences the problem due to an infrequent overuse of the musculotendinous unit where the tissues are not functionally adapted to the effort. Within a few hours after a hard session of the unaccustomed effort, the muscle fibers show degenerative changes, lose glycogen content, and accumulate lactic acid. These acidic waste particles of inflammation spread about the tissues around the tendon, causing edematous swelling and pain.

Rest followed by massage, anti-inflammatory drugs, and progressive exercise are the generally prescribed treatment. Additionally, light exercise, using gradually increasing weight, combined with proper positioning of the hand to isolate the long extensors for lateral epicondylitis, and the flexors for medial epicondylitis can greatly accelerate the healing process. Progressive exercise serves two functions, first this exercise artificially stimulates the blood circulation about the affected area, which acts to pump the waste products of inflammation from the area, and second, exercise gradually builds up the strength of the specific muscles involved in the injury, which helps prevent recurrence of the injury.

Various devices addressing bracing, pressure, or exercising have been proposed to minimize the effects of epicondylitis. Bracing devices have been designed to prevent full extension of the elbow joint. Pressure application devices apply some constant pressure for pain relief. These devices are generally worn while the patient engages in the aggravating activity, do not provide pain reduction other than while the activity is performed, and do not have a rehabilitation effect. Many simple exercise devices exist, none of which allows precise positioning and load application to relieve epicondylitis.

A need has thus arisen for a rehabilitation device to provide for pain reduction and rehabilitation of injuries caused by epicondylitis. A need has arisen for a rehabilitation device for progressively loading the affected muscles, and which provides for the correct positioning of the load to isolate and work the musculotendinous areas involved in the injury.

SUMMARY OF THE INVENTION

In accordance with the present invention, an elbow and forearm rehabilitation device to be grasped by a hand of a user includes a frame having first and second side members. Each side member includes first and second ends. A hand grip is interconnected to the first ends of the side members for receiving the hand of the user between the first and second side members. The first and second side members include a bend disposed between the first and second ends, such that the first and second side members disposed between the bend and the second ends lie in a plane substantially parallel to the plane of the user's arm when the back of the hand is rotated, upon full rotation of the wrist, toward the user's elbow.

In accordance with another aspect of the present invention, an elbow and forearm rehabilitation device to be grasped by a hand of a user is provided. The device includes a frame having first and second side members. Each side member includes first and second ends. A hand grip is interconnected to the first ends of the first and second side members for receiving the hand of the user between the first and second side members. The side members include a bend disposed between the first and second ends. Weights are selectively disposed adjacent the second ends of the side members. Structure is further provided for receiving the fingers of the user which is disposed between the side members and adjacent to the hand grip.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
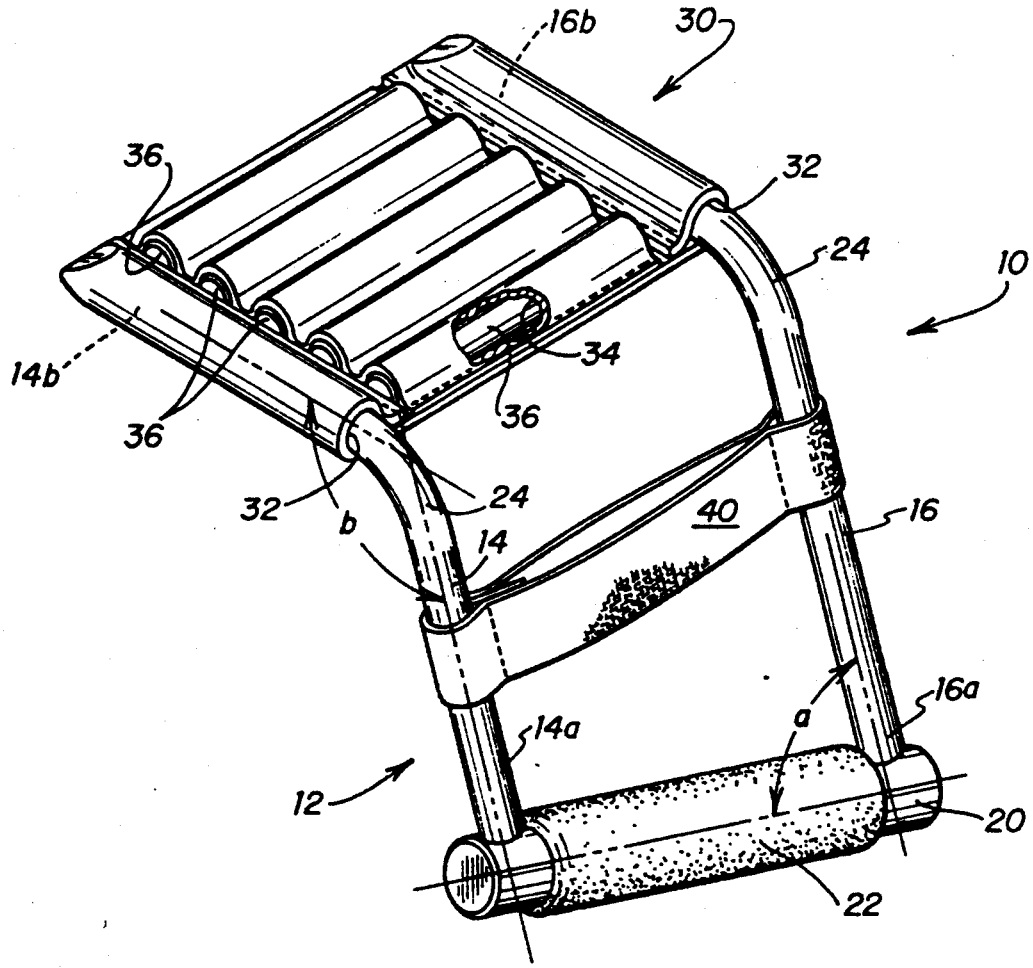
FIG. 1 is a perspective view of the present elbow and forearm rehabilitation device.

Referring to FIG. 1, the present elbow and forearm rehabilitation device is illustrated, and is generally identified by the numeral 10. FIG. 1 illustrates the present rehabilitation device 10 for a right handed configuration whereas FIG. 6, to be subsequently described, illustrates the present rehabilitation device 10 for a left handed configuration. Rehabilitation device 10 includes a frame, generally identified by the numeral 12 including side members 14 and 16. Side member 14 includes ends **14*a* and 14*b*. Side member 16 includes ends 16*a* and 16*b*. Side members 14 and 16** may comprise, for example, hollow tubing.

Figure 2:
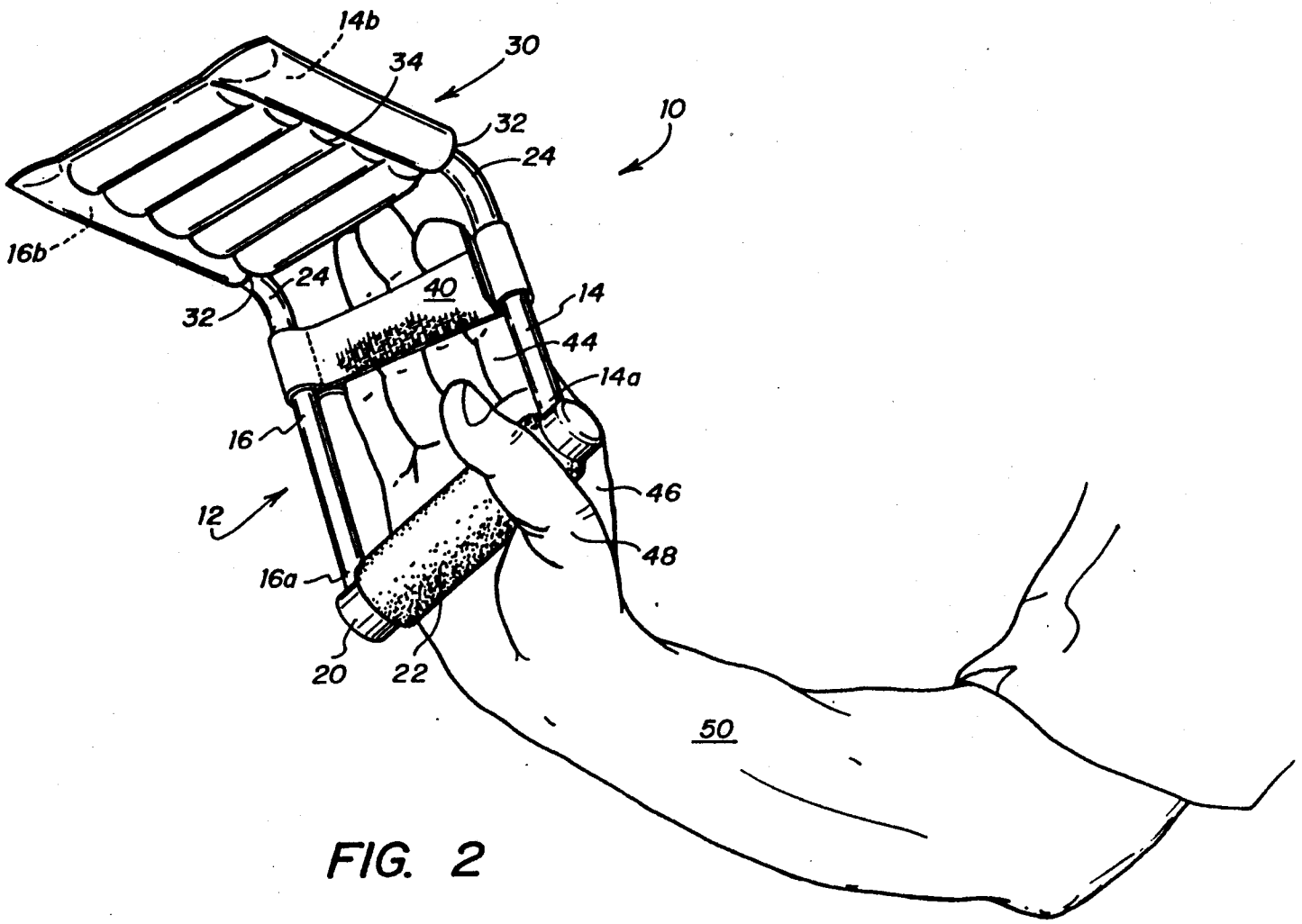
FIG. 2 is a perspective view of the present elbow and forearm rehabilitation device shown in FIG. 1 illustrating a first grip position.

Interconnected between ends **14*a* and 16*a* of side members 14 and 16, respectively, is a hand grip 20. Hand grip 20 maintains side members 14 and 16 spaced apart and generally parallel to each other such that a hand of a user can be disposed between side members 14 and 16 as illustrated in FIG. 2. Disposed around hand grip 20 is a hand grip pad 22**.

Hand grip 20 is disposed relative to side members 14 and 16 at an angle of approximately, for example, 67 degrees illustrated in FIG. 1 as angle a. This angle conforms to the orientation of the proximal palmar crease, which originates at the base of the index finger and extends across and downward to the muscular pad at the inside heel of the palm. This angle positions elbow and forearm rehabilitation device 10 parallel to the fingers when grasped so that the load remains centered above the fingertips throughout the prescribed range of motion.

An important aspect of the present invention is the formation of a bend 24 positioned between ends 14*a* and 14*b* of side member 14 and ends 16*a* and 16*b* of side member 16. Bends 24 are located between ends 14*a* and 14*b* on side member 14 and between ends 16*a* and 16*b* on side member 16, are parallel to each other, and form an angle of approximately between 50 degrees and 70 degrees illustrated by angle b in FIG. 1. This angle is the complement of the angle formed by holding the forearm horizontal and extending the hand upward toward the elbow to the end of the hand's range. Angle b positions weight horizontally outwardly from the fingertips so that the full load is applied at full rotation of the wrist where the back of the hand is rotated toward the elbow in the exercise for lateral epicondylitis, and at full rotation of the wrist, where the palm of the hand is rotated toward the elbow in the exercise for medial epicondylitis.

Attached to ends 14*b* and 16*b* and between side members 14 and 16 is a weight retaining pouch, generally identified by the numeral 30. Weight retaining pouch 30 is slidably received by ends 14*b* and 16*b* of side members 14 and 16, respectively, through apertures 32. Weight retaining pouch 30 includes a plurality of pouches 34 for the selective insertion of weights 36. Any number of weights 36 may be inserted into pouches 34 to provide for progressive loading of elbow and forearm rehabilitation device 10 during an exercise routine. Bend 24 positions weight retaining pouch 30 so that the maximum load is applied when the wrist of the hand is at a full rotation, either the back of the hand or palm being rotated towards the elbow, thereby concentrating the exercise and rehabilitation effect of the present device 10 in the injured area.

Figure 3:
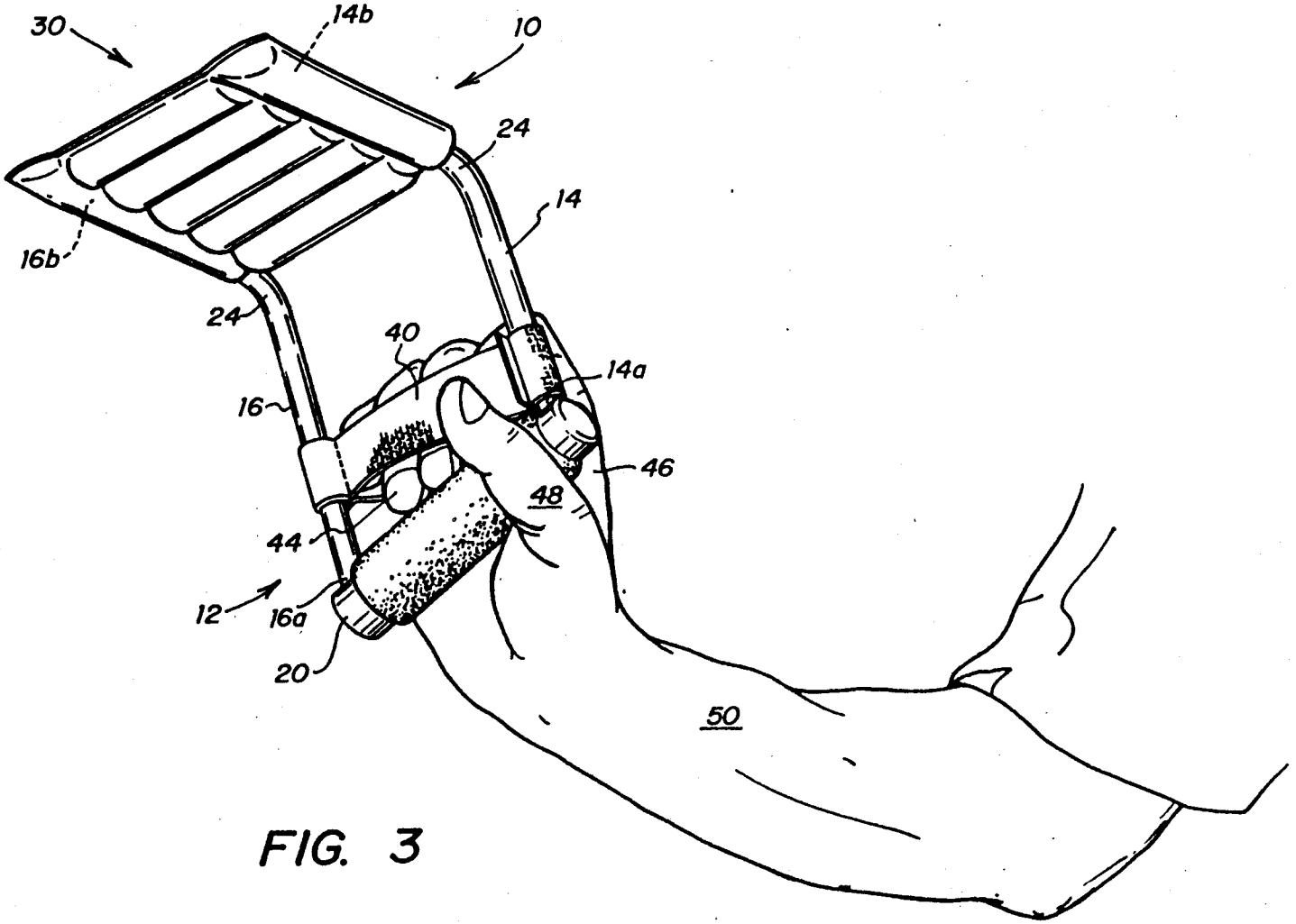
FIG. 3 is a perspective view of the present elbow and forearm rehabilitation device shown in FIG. 1 illustrating a second grip position.

Disposed between side members 14 and 16 and adjacent to hand grip 20 is a strap 40. Strap 40 is slidable along side members 14 and 16 and is positionable for receiving the fingers of the user for grip positions as illustrated in FIGS. 2 and 3, to be subsequently described. Strap 40 is used to enclose the fingertips so that constant pressure can be maintained on the extensors in the hand grip illustrated in FIG. 2.

Referring to FIG. 2, a first grip position for use with the present elbow and forearm rehabilitation device 10 is illustrated. Fingers 44 of the user's hand 46 are disposed between side members 14 and 16 and are positioned within strap 40 entering from the direction of hand grip 20. Fingers 44 are fully extended and thumb 48 is disposed around hand grip 20.

FIG. 3 illustrates a second grip position for use with the present elbow and forearm rehabilitation device 10 in which strap 40 is slid toward hand grip 20. Fingers 44 of the user's hand 46 are inserted into strap 40, entering from the direction of weight retaining pouch 30, and are bent toward hand grip 20. Thumb 48 is positioned in a manner similar to that shown in FIG. 2, being wrapped around hand grip 20.

Figure 4:
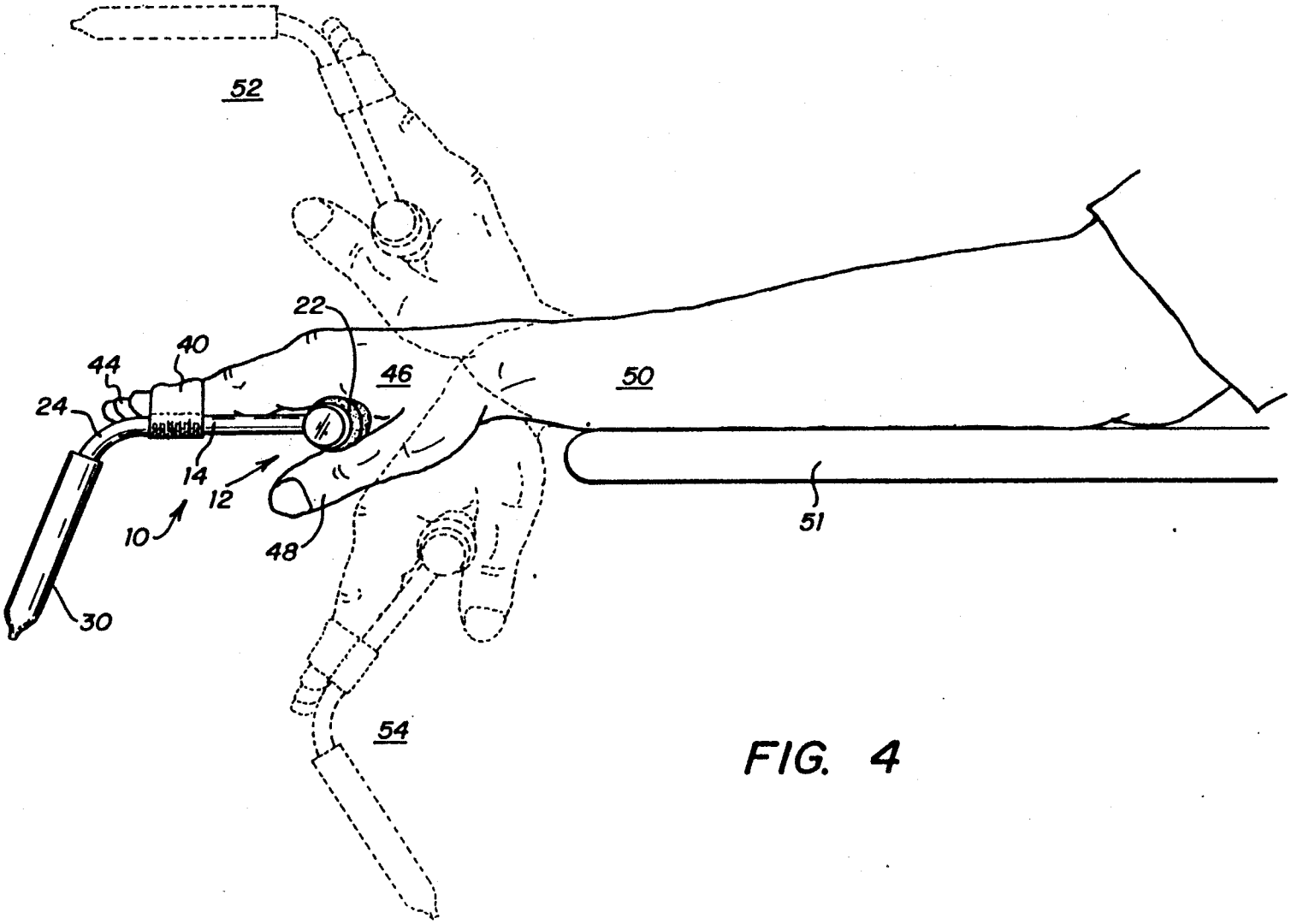
FIG. 4 is a side elevational view of the elbow and forearm rehabilitation device shown in FIG. 2 illustrating a first exercise.

FIG. 4 illustrates the use of the present rehabilitation device 10 being grasped by the grip as shown in FIG. 2 for use in a first exercise. Forearm 50 of the user is positioned in a horizontal manner such as, for example, by resting the forearm 50 on a knee, arm of a chair, or other support 51 where the forearm 50 is horizontal and the wrist unsupported. The hand 46 of the user is then rotated upwardly to the position identified by reference numeral 52, such that the portion of side members 14 and 16 located between bend 24 and ends 14*b* and 16*b*, respectively, lie in a plane substantially parallel to the plane of the user's forearm 50. This position enables achievement of the maximum load when the hand 46 is at full extension to correctly position the load to isolate and work the musculotendinous areas involved in the injury. The hand 46 is then lowered to the position illustrated by reference numeral 54. The exercise is repeated by moving the hand 46 between the positions 52 and 54. Pressure is maintained on strap 40 throughout both the upward and downward motions. The exercise illustrated in FIG. 4 can also be accomplished utilizing the second grip position shown in FIG. 3.

Figure 5:
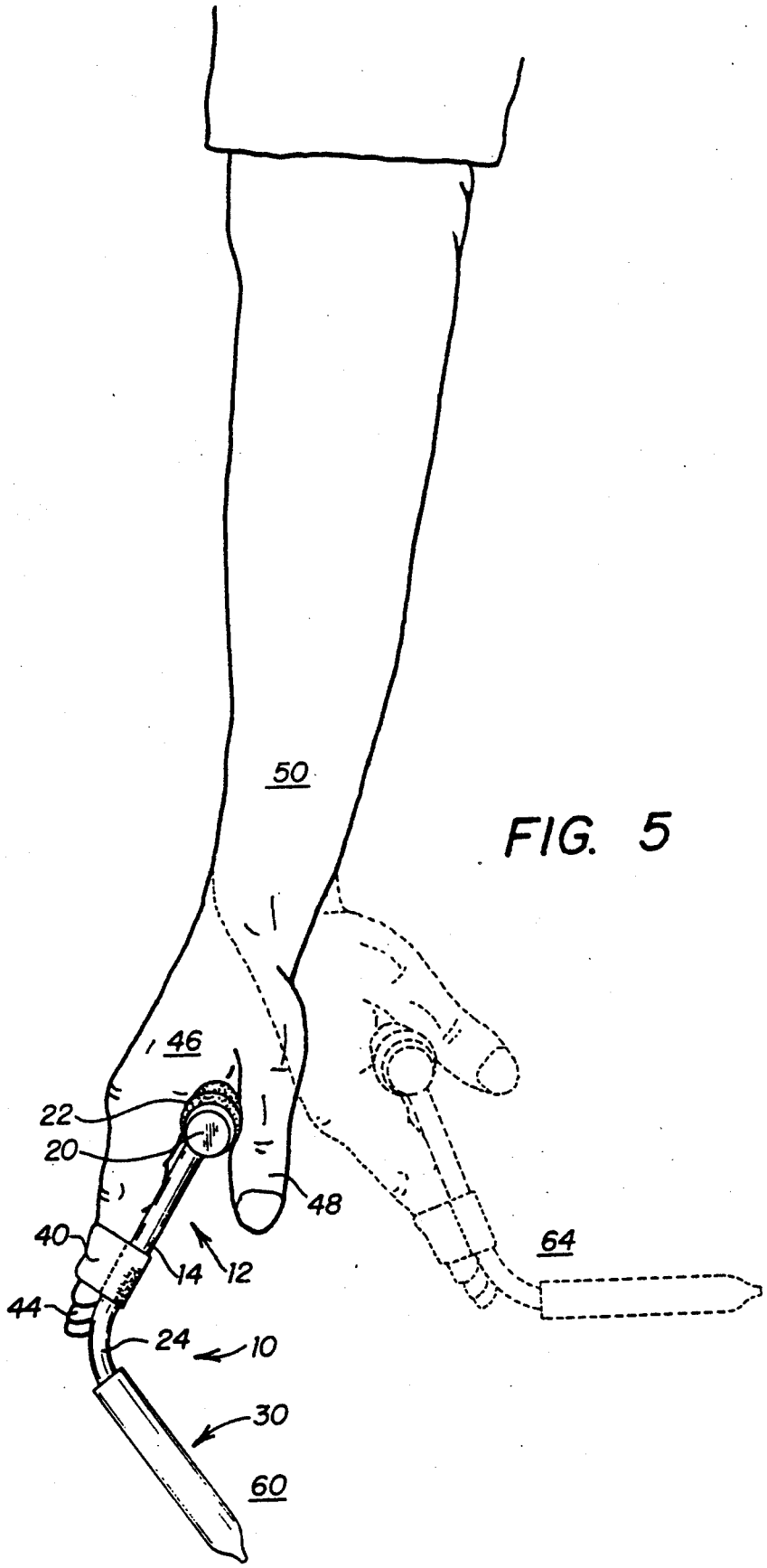
FIG. 5 is a side elevational view of the elbow and forearm rehabilitation device shown in FIG. 2 illustrating a second exercise.

Referring to FIG. 5, a second exercise utilizing the present elbow and forearm rehabilitation device 10 is illustrated. Utilizing the first grip position, the user places the forearm 50 at his or her side and bent slightly forward with the palm facing backwards as shown in the position identified by reference numeral 60. The hand 46 is then rotated rearwardly to the position identified by reference numeral 64 such that the load is horizontal and generally perpendicular to forearm 50, and the exercise is repeated by moving hand 46 between the positions identified by reference numerals 60 and 64. Additionally, this exercise can be accomplished utilizing the second grip position as illustrated in FIG. 3.

As illustrated in FIGS. 4 and 5, rehabilitation device 10 allows for the full range of motion of the wrist of a user with loading throughout the entire range of motion. The maximum load is achieved at the ends of the range of motion so that the full load is applied at full extension of the hand in the exercise for lateral epicondylitis and at full flexion in the exercise for medial epicondylitis.

Figure 6:
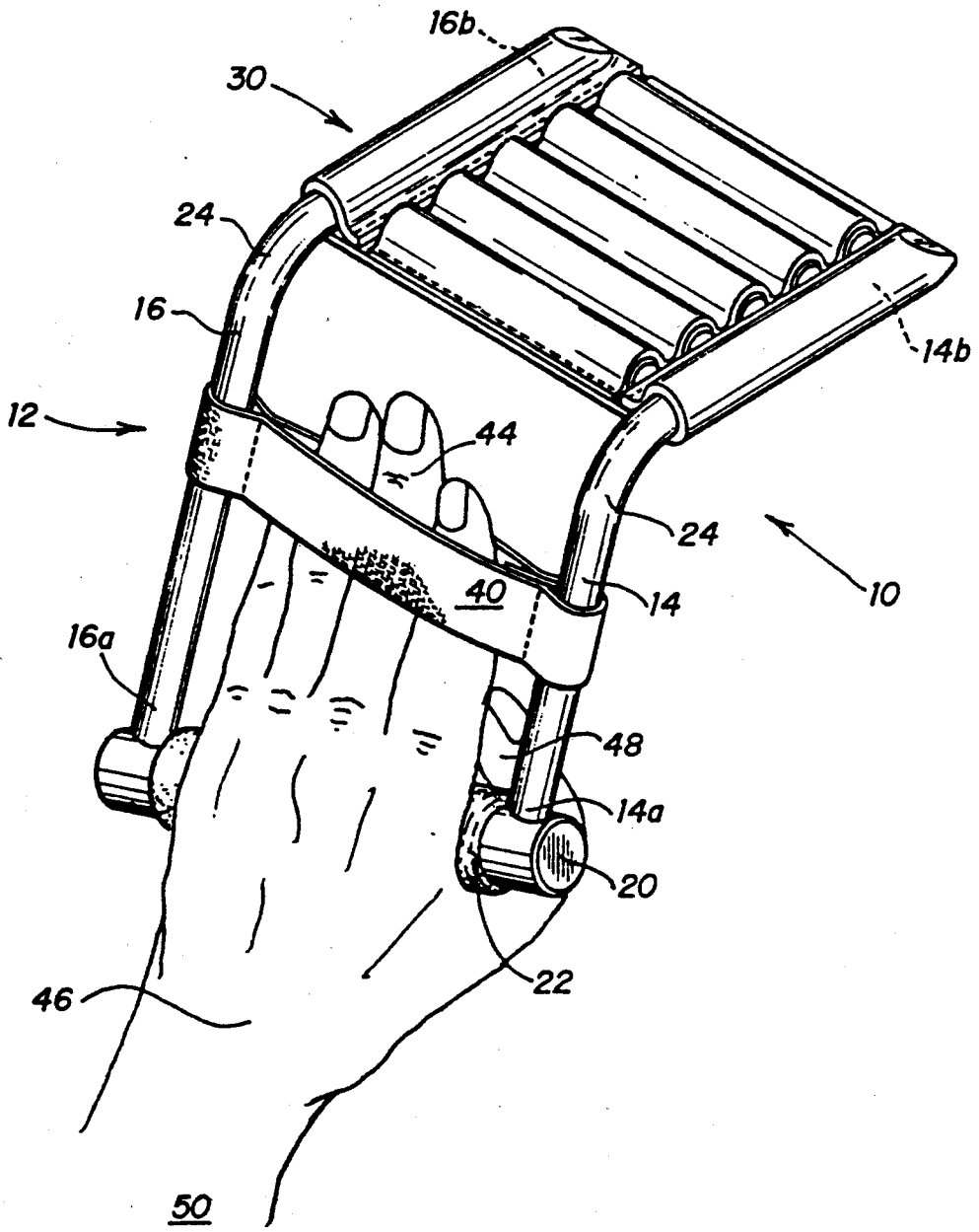
FIG. 6 is a perspective view of the present elbow and forearm rehabilitation device for use in a left hand configuration.

FIG. 6 illustrates the use of elbow and forearm rehabilitation device 10 for use by the left hand of a user. Side members 14 and 16 are rotated 180 degrees with respect to hand grip 20 by the removal of weight retaining pouch 30. After rotation of side members 14 and 16, weight retaining pouch 30 is reassembled to side members 14 and 16. The grip positions illustrated in FIGS. 2 and 3 are the same for use with the left hand as for the right hand as illustrated in FIGS. 2 and 3.

It therefore can be seen that the present rehabilitation device provides for the rehabilitation of common elbow and forearm injuries, especially lateral and medial epicondylitis. The frame of the present invention enables achievement of the maximum load when the hand is at a full rotation, either the back of the hand or palm rotated fully towards the elbow, thereby concentrating the effect of this load on the injured area. The finger strap and hand grip combination allows the patient's hand to be correctly positioned to isolate the musculotendinous unit involved in the injury. The present rehabilitation device includes adjustable weights for various stages of injury rehabilitation and for building strength after recovery.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. An elbow and forearm rehabilitation device to be grasped by a hand of a user comprising:

a frame, including first and second side members, each having a first end proximal the user and a second end distal the user, a hand grip interconnected to said first ends of said first and second side members for receiving the hand of the user between the first and second side members; and said first and second side members including a bend disposed between said first and second ends, such that the portion of said first and second side members disposed between said bend and said second distal ends lie in a plane substantially parallel to the plane of the user's arm when the back of the hand is rotated toward the user's elbow.

2. The rehabilitation device of claim 1 wherein said bend includes an angle of approximately 65 degrees.

3. The rehabilitation device of claim 1 and further including:

weights disposed adjacent said second ends of said side members.

4. The rehabilitation device of claim 3 wherein said weights extend between said side members.

5. The rehabilitation device of claim 1 and further including:

a plurality of weights; and means for selectively receiving said plurality of weights disposed adjacent said second distal ends of said side members and further extending between said side members.

6. The rehabilitation device of claim 1 and further including:

means for receiving the fingers of the user's hand, said finger receiving means being disposed between said side members adjacent and spaced apart from said hand grip.

7. The rehabilitation device of claim 6 wherein said finger receiving means is slidably mounted on said side members for movement along said side members between said hand grip and said bend.

8. The rehabilitation device of claim 1 wherein said hand grip and one of said first proximal ends of said side members are interconnected to form an angle of approximately 65 degrees.

9. The rehabilitation device of claim 8 wherein said bend forms an angle of approximately 65 degrees.

10. An elbow and forearm rehabilitation device to be grasped by a hand of a user, comprising:

a frame including first and second side members, each having a first end proximal the user and a second end distal the user;

a hand grip interconnected to said first proximal ends of said first and second side members for receiving the hand of the user between said first and second side members;

said first and second side members including a bend disposed between said first proximal and second distal ends;

weights disposed adjacent said second distal ends of said side members; and means for receiving the fingers of the user, said finger receiving means being disposed between said side members adjacent and spaced apart from said hand grip.

11. The rehabilitation device of claim 10 wherein said finger receiving means is slidably mounted on said side members for movement along said side members between said hand grip and said bend.

12. The rehabilitation device of claim 10 and further including:

means for selectively receiving said weights disposed adjacent said second distal ends of said side members and extending between said side members.

13. The rehabilitation device of claim 10 wherein said hand grip and one of said first proximal ends of said side members are interconnected to form an angle of approximately 65 degrees and said bend forms an angle of approximately 65 degrees.

14. An elbow and forearm rehabilitation device to be grasped by a hand of a user, comprising:

a frame including first and second side members, each having a first end proximal the user and a second end distal the user;

a hand grip interconnected to said first proximal ends of said first and second side members for receiving the hand of the user between said first and second side members;

said first and second side members including a bend disposed between said first proximal and second distal ends;

a plurality of weights;

means for selectively receiving said plurality of weights disposed adjacent said second distal ends of said side members and extending between said side members; and finger receiving means slidably mounted, on said side members adjacent and spaced apart from said hand grip for movement along said side members between said hand grip and said bend.

15. The rehabilitation device of claim 14 wherein said receiving means is slidably mounted to said second distal of said side members and includes slotted apertures for receiving said plurality of weights.

16. The rehabilitation device of claim 14 wherein said first proximal ends of said side members are rotatably mounted to said hand grip for selecting right hand or left hand use of the rehabilitation device.

17. The rehabilitation device of claim 14 wherein said hand grip and one of said first proximal ends of said side members are interconnected to form an angle of approximately 65 degrees.

18. The rehabilitation device of claim 14 wherein said bend forms an angle of approximately 65 degrees.

19. The rehabilitation device of claim 14 wherein said hand grip and one of said first proximal ends of said side members are interconnected to form an angle of approximately 65 degrees and wherein said bend forms an angle of approximately 65 degrees.

20. The rehabilitation device of claim 14 wherein said side members comprise tubular members.

* * * * *